US005634782A

United States Patent [19]

Akazawa et al.

[11] Patent Number: 5,634,782

[45] Date of Patent: Jun. 3, 1997

[54] SCROLL COMPRESSOR HAVING A HORSESHOE-SHAPED PARTITION WALL ON THE STATIONARY END PLATE

[75] Inventors: Teruyuki Akazawa, Kusatsu; Sadao Kawahara, Otsu; Akihiko Shimizu; Yoshifumi Abe, both of Kusatsu, all of Japan

[73] Assignee: Matsushita Electric Industrial Co., Ltd., Osaka-fu, Japan

[21] Appl. No.: 613,318

[22] Filed: Mar. 11, 1996

Related U.S. Application Data

[62] Division of Ser. No. 498,139, Jul. 5, 1995.

[30] Foreign Application Priority Data

Nov. 30, 1994 [JP] Japan ..... 6-296751

[51] Int. Cl.[6] ..... F04C 18/04

[52] U.S. Cl. ..... 418/55.2

[58] Field of Search ..... 418/55.1, 55.2

[56] References Cited

U.S. PATENT DOCUMENTS 4,411,604 10/1983 Terauchi ..... 418/55.1

4,815,952 3/1989 Hasegawa ..... 418/55.2

5,511,952 4/1996 Sato ..... 418/55.1

FOREIGN PATENT DOCUMENTS 60-1396 1/1985 Japan ..... 418/55.1

*Primary Examiner*—John J. Vrablik

*Attorney, Agent, or Firm*—Wenderoth, Lind & Ponack

[57] ABSTRACT

A scroll compressor includes stationary and orbiting scroll members in engagement with each other. The stationary scroll member includes a stationary end plate having first and second end surfaces opposite to each other, a stationary scroll wrap protruding axially from the first end surface of the stationary end plate, a discharge port defined in the stationary end plate in the proximity of a center thereof, a generally horseshoe-shaped partition wall protruding axially from the second end surface of the stationary end plate, and spaced apart mounting legs protruding axially from the second end surface of the stationary end plate and continuous with the partition wall in such a manner that the partition wall extends between the mounting legs. Each of the mounting legs has a thickness greater than that of the partition wall and also has a height slightly greater than that of the partition wall.

2 Claims, 6 Drawing Sheets

SCROLL COMPRESSOR HAVING A HORSESHOE-SHAPED PARTITION WALL ON THE STATIONARY END PLATE

This is a divisional application of Ser. No. 08/498,139, filed Jul. 5, 1995.

BACKGROUND OF THE INVENTION

1. Field of the Invention

The present invention relates to a scroll compressor for use in, for example, an air conditioner, a refrigerator or the like.

2. Description of Related Art

In view of numerous features including that they are compact and light-weight have, a high operating efficiency and low noise generation and so on, scroll compressors have gained wide market acceptance. Scroll compressors and their operating principles are disclosed in numerous patent and technical literature and are, therefore, well known to those skilled in the art.

As typical examples of the scroll compressor, Japanese Patent Publication (examined) No. 57-49721, published in 1982, discloses a scroll-type fluid machine, while U.S. Pat. No. 4,824,346 discloses a scroll compressor including an eccentric bush mechanism.

FIGS. 5 and 6 depict a conventional scroll compressor and reference thereto will now be made for discussion of the prior art. The conventional scroll compressor shown therein comprises a compressor housing 101 having a rear end portion to which a stationary scroll member 102 in the form of a stationary end plate 103 having a stationary scroll wrap 104 formed on one surface thereof is secured. An orbiting scroll member 106 in the form of an orbiting end plate 107 having an orbiting scroll wrap 108 formed on one surface thereof is accommodated within the compressor housing 101 with the orbiting scroll wrap 108 being in engagement with the stationary scroll wrap 104 of the stationary scroll member 102 to define a plurality of volume-variable sealed working pockets 105 therebetween. The opposite surface of the stationary end plate 103 remote from the stationary scroll wrap 104 is formed with a generally cylindrical partition wall 130 having an end surface secured to the compressor housing 101.

As clearly shown in FIG. 6, the partition wall 130 has a plurality of mounting legs 131 integrally formed therewith and having a thickness greater than that of the partition wall 130. A plurality of bolts 125 extending through a rear wall of the compressor housing 101 are threaded into associated mounting legs 131 to fasten the stationary scroll member 102 to the compressor housing 101.

Referring further to FIG. 5, the opposite surface of the orbiting end plate 107 remote from the orbiting scroll wrap 108 is formed with a generally cylindrical boss 109 in which an annular orbiting bearing 110 is disposed. An eccentric bush 111 in the form of a stud shaft or a disc having a substantial wall thickness and having an eccentric hole 112 defined therein is engaged with and rotatably housed within the annular orbiting bearing 110.

A main shaft 114 has one end formed with an eccentric rod 115 so as to protrude axially from an end surface thereof. The eccentric rod 115 integral with the main shaft 114 is rotatably received in the eccentric hole 112 of the eccentric bush 111 so that, during rotation of the main shaft 114 about its own longitudinal axis, the eccentric rod 115 undergoes an eccentric motion relative to the main shaft 114 to impart an orbiting motion to the orbiting scroll member 106. By this construction, a gaseous medium is introduced into the sealed working pockets 105 which in turn move inwardly around the stationary and orbiting scroll wraps 104 and 108 towards a center discharge port 123 accompanied by progressive reduction in volume thereof. Therefore, the gaseous medium trapped in each sealed working pocket 105 experiences a decrease in volume and an increase in pressure as it approaches the center discharge port 123. Because the center discharge port 123 is opened or closed by a check valve 121, if the pressure inside the working pocket 105 positioned in the proximity of the center discharge port 123 is greater than that of a high-pressure chamber 120 separated therefrom by the check valve 121, the check valve 121 is opened to thereby discharge the compressed gaseous medium accommodated in the working pocket 105 to the high-pressure chamber 120 through the center discharge port 123.

However, the conventional scroll compressor of the above-described construction encounters a problem associated with back-flow of the high-pressure gaseous medium which has been hitherto caused by delayed closure of the check valve 121. In particular, in a scroll compressor having a relatively low compression ratio, the amount of the compressed gaseous medium that flows back into the working pocket 105 from the high-pressure chamber 120 increases, and a resultant reexpansion of the gaseous medium lowers the compression efficiency, thus resulting in a reduction in performance of the scroll compressor.

This conventional scroll compressor has an additional problem in securement of the stationary scroll member 102 within the compressor housing 101. Specifically, forces required to tighten fastening members such as, for example, bolts 125 inevitably generate strains in the stationary scroll member 102 and, hence, no uniform gap can be obtained between the stationary and orbiting scroll wraps 104 and 108, which would eventually result in leakage of the refrigerant. This in turn brings about a reduction in performance of the scroll compressor.

SUMMARY OF THE INVENTION

The present invention has been developed to overcome the above-described disadvantages and is intended to provide a scroll compressor having an improved stationary scroll member to increase the compression efficiency.

In accomplishing the above and other objectives, the scroll compressor of the present invention comprises a compressor housing and stationary and orbiting scroll members in engagement with each other. The stationary scroll member comprises a stationary end plate having first and second end surfaces opposite to each other, a stationary scroll wrap protruding axially from the first end surface of the stationary end plate, a discharge port defined in the stationary end plate at a location close to a center thereof, and a recess defined in the stationary end plate on the second surface thereof. A check valve is received in the recess of the stationary end plate so as to open or close the discharge port. The recess has a shape substantially identical to the shape of the check valve and also has a depth greater than a maximum lift of the check valve.

By the above-described construction, for a compressed gaseous medium in a high-pressure chamber defined between the stationary end plate and the compressor housing to flow back into a working pocket adjacent thereto, the gaseous medium is required to pass through extremely narrow gaps defined between opposite side surfaces of the check valve and associated inner side walls of the recess. As a result, the resistance to flow increases followed by a decrease in the amount of the high-pressure gas flowing back into the working pocket, thus lessening a reduction in compression efficiency caused by reexpansion of the high-pressure gas.

The second surface of the stationary end plate may be formed with a generally horseshoe-shaped partition wall and a plurality of spaced mounting legs, both protruding axially therefrom. In this case, each of the mounting legs has a thickness greater than that of the partition wall and also has a height slightly greater than that of the partition wall.

This construction results in formation of gaps defined between the partition wall and an inner surface of the compressor housing to which the mounting legs of the stationary scroll member are secured. These gaps act to absorb strains resulting from tightening of fastening members by which the mounting legs of the stationary scroll member are secured to the compressor housing, resulting in a uniform gap between the stationary and orbiting scroll wraps and avoiding a reduction in performance of the compressor following leakage of a refrigerant.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

Figure 1:
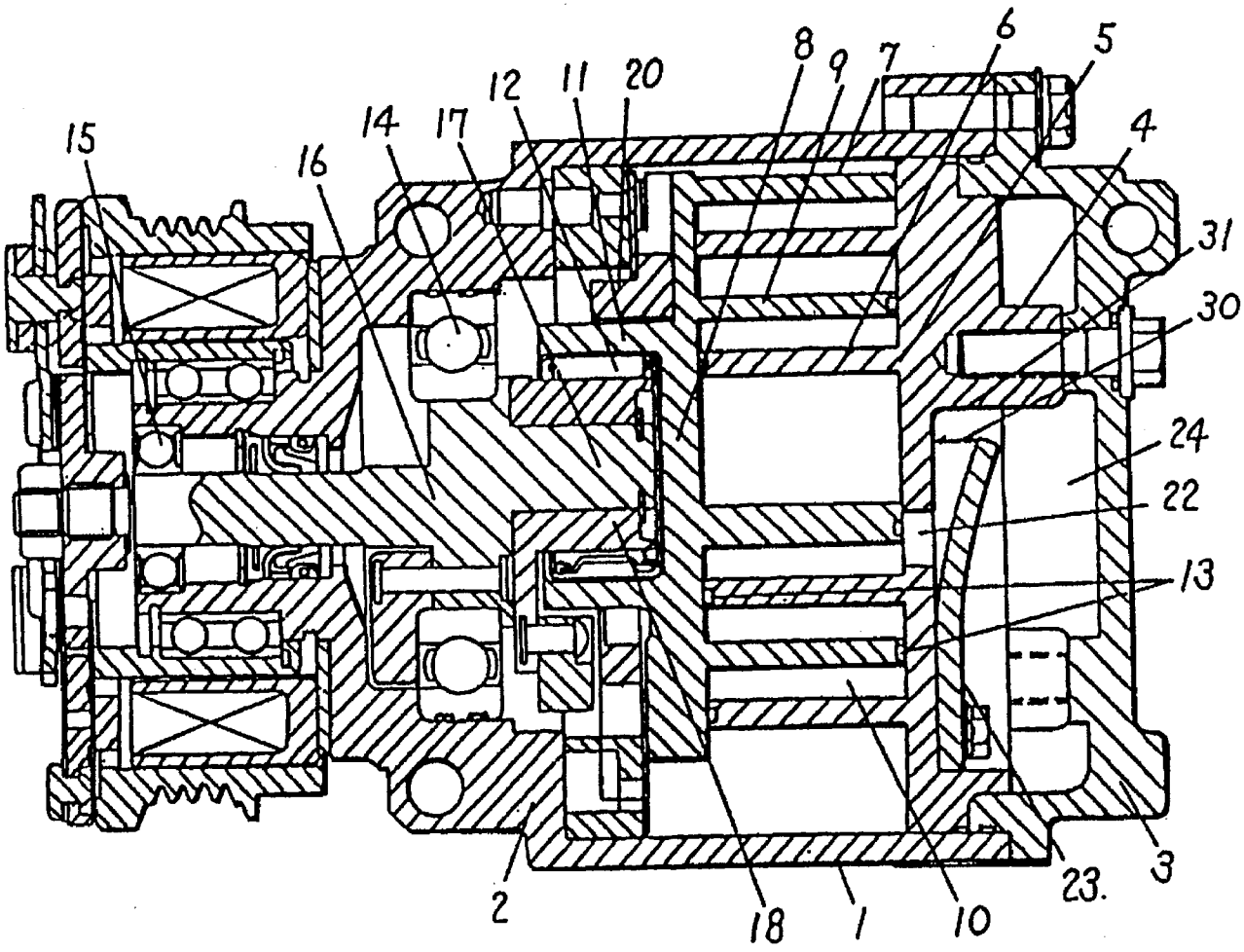
FIG. 1 is a longitudinal sectional view of a scroll compressor according to a first preferred embodiment of the present invention.
Figure 2A:
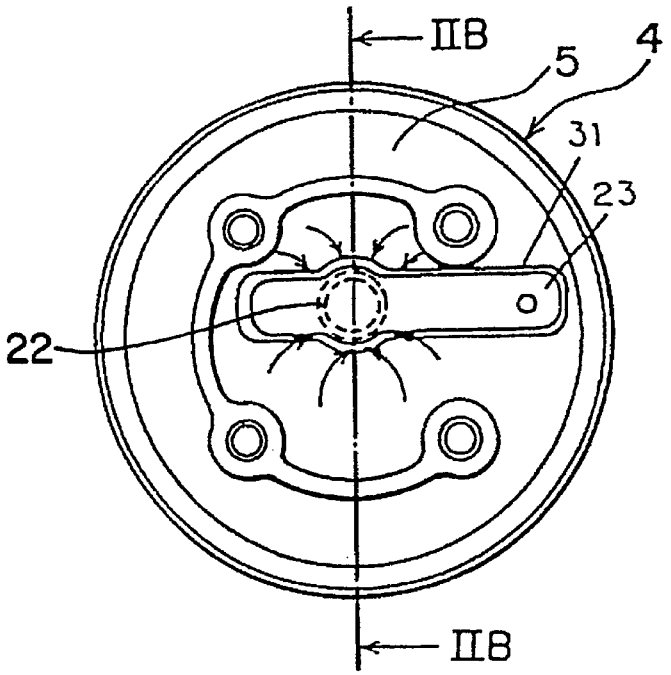
FIG. 2A is an enlarged rear end view of a stationary scroll member mounted in the scroll compressor of FIG. 1.
Figure 2B:
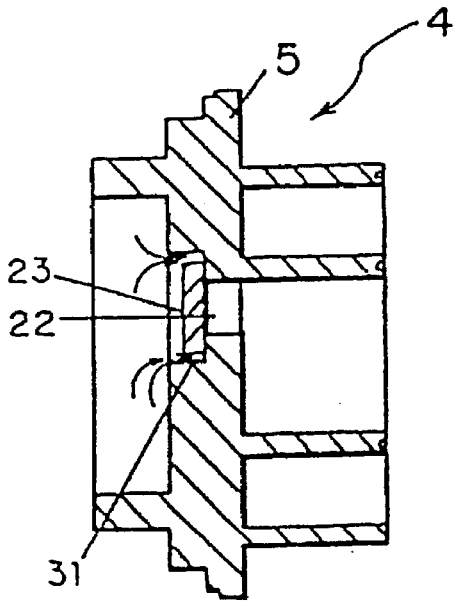
FIG. 2B is a cross-sectional view taken along line IIB—IIB in FIG. 2A.

Referring now to the drawings, there is shown in FIG. 1 a scroll compressor according to a first embodiment of the present invention which includes a stationary scroll member shown in FIGS. 2A and 2B.

The scroll compressor shown in FIG. 1 comprises a generally cylindrical compressor housing 1 including a front casing 2, in which a relatively low pressure acts, and a rear casing 3 in which a relatively high pressure acts. The front casing 2 is coupled in end-to-end fashion with the rear casing 3 to complete the generally cylindrical compressor housing 1. A stationary scroll member 4, including a stationary end plate 5 and a stationary scroll wrap 6 protruding axially from one end surface of the stationary end plate 5, and an orbiting scroll member 7 similarly including an orbiting end plate 8 and an orbiting scroll wrap 9 protruding axially from one end surface of the orbiting end plate 8 are operatively accommodated within the compressor housing 1 with the stationary and orbiting scroll wraps 6 and 9 engaging with each other to define a plurality of volume-variable, sealed working pockets 10.

The stationary scroll member 4 is fixed in position with the stationary end plate 5 fastened to a front end portion of the rear casing 3 adjacent the front casing 2. On the other hand, the orbiting end plate 8 is formed on a rear surface with a cylindrical boss 11 extending concentrically and transversely from the orbiting end plate 8 in a direction away from the stationary scroll member 4 and receiving therein an annular orbiting bearing 12 which may be a needle bearing. An axial outer end of each of the stationary and orbiting scroll wraps 6 and 9 opposite to the axial inner ends integrated with the corresponding end plate 5 or 8 has a tip seal 13 fitted thereto and held in sliding contact with a confronting end surface of the respective end plate 5 or 8 to establish an axial seal.

The orbiting bearing 12 is fixedly mounted in the cylindrical boss 11 of the orbiting scroll member 7, while an eccentric bush 18 is inserted rotatably into the orbiting bearing 12. A main shaft 16 is rotatably supported within the compressor housing 1 by means of a main roller bearing 14 and an auxiliary roller bearing 15 and has a front end integrally formed with an eccentric stud shaft 17 having its longitudinal axis parallel to, but offset a predetermined distance, corresponding to the orbiting radius, laterally from the longitudinal axis of the main shaft 16, which shaft 17 is engaged in the eccentric bush 18. This construction causes the orbiting scroll member 7 to undergo an orbiting motion relative to the stationary scroll member 4, while rotation of the orbiting scroll member 7 about its own axis is prevented by a constraint member 20.

As is well known to those skilled in the art, the orbiting motion of the orbiting scroll member 7 relative to the stationary scroll member 4 results in the sealed working pockets 10 moving inwardly around the stationary and orbiting scroll wraps 6 and 9 towards a center discharge port 22 accompanied by progressive reduction in volume thereof. Therefore, a gaseous medium entering into each sealed working pocket 10 through an inlet port (not shown) experiences a decrease in volume and an increase in pressure as it approaches the center discharge port 22 defined in the stationary scroll member 4. The compressed gaseous medium subsequently opens a generally flat check valve 23 mounted on the stationary scroll member 4 and is discharged into a discharge cavity or high-pressure chamber 24. The gaseous medium so discharged into the high-pressure chamber 24 flows out of the compressor housing 1 through an outflow port (not shown) defined in the compressor housing 1.

As shown in FIGS. 2A and 2B, the stationary end plate 5 has a recess 31 defined therein on the rear surface thereof, in which the generally flat check valve 23 is received. The check valve 23 resiliently opens or closes the center discharge port 22 according to the pressure difference between the high-pressure chamber 24 and a working pocket 10 adjacent thereto and has a fixed end connected to the stationary end plate 5 and an opposite free end. The recess 31 is of a shape substantially identical to, but slightly larger than the shape of the check valve 23 and has a depth greater than a maximum lift of the check valve 23 i.e., a distance of movement of the free end of the check valve 23. Accordingly, if delayed closure of the check valve 23 causes the compressed gaseous medium in the high-pressure chamber 24 to flow back into the working pocket 10 adjacent thereto, the gaseous medium is required to pass through extremely narrow gaps defined between opposite side surfaces of the check valve 23 and associated inner side walls of the recess 31. This phenomenon increases the resistance to flow and decreases the amount of the high-pressure gas flowing back into the working pocket 10, thus lessening a reduction in compression efficiency caused by reexpansion of the high-pressure gas.

Figure 3:
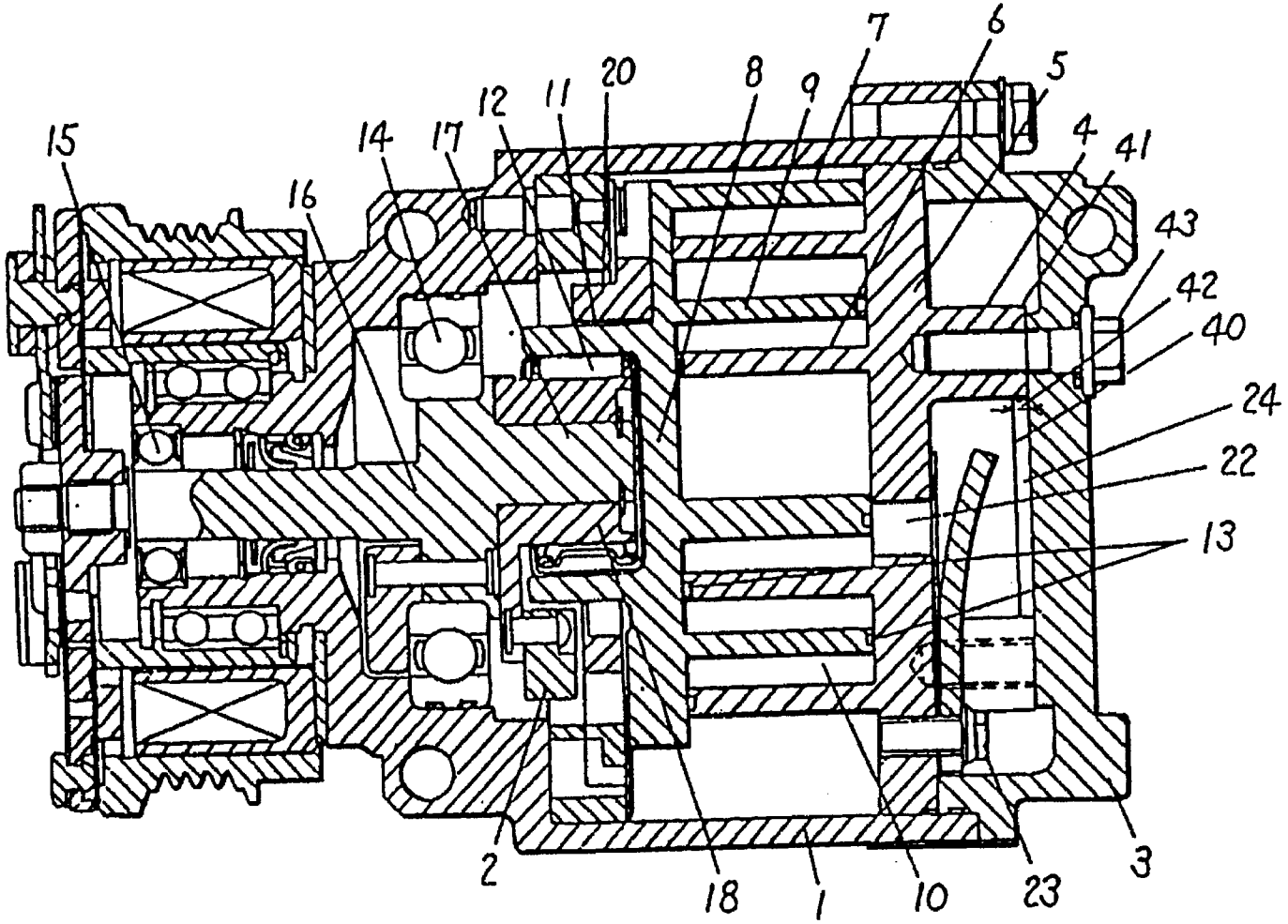
FIG. 3 is a view similar to FIG. 1, but according to a second embodiment of the present invention.
Figure 4:
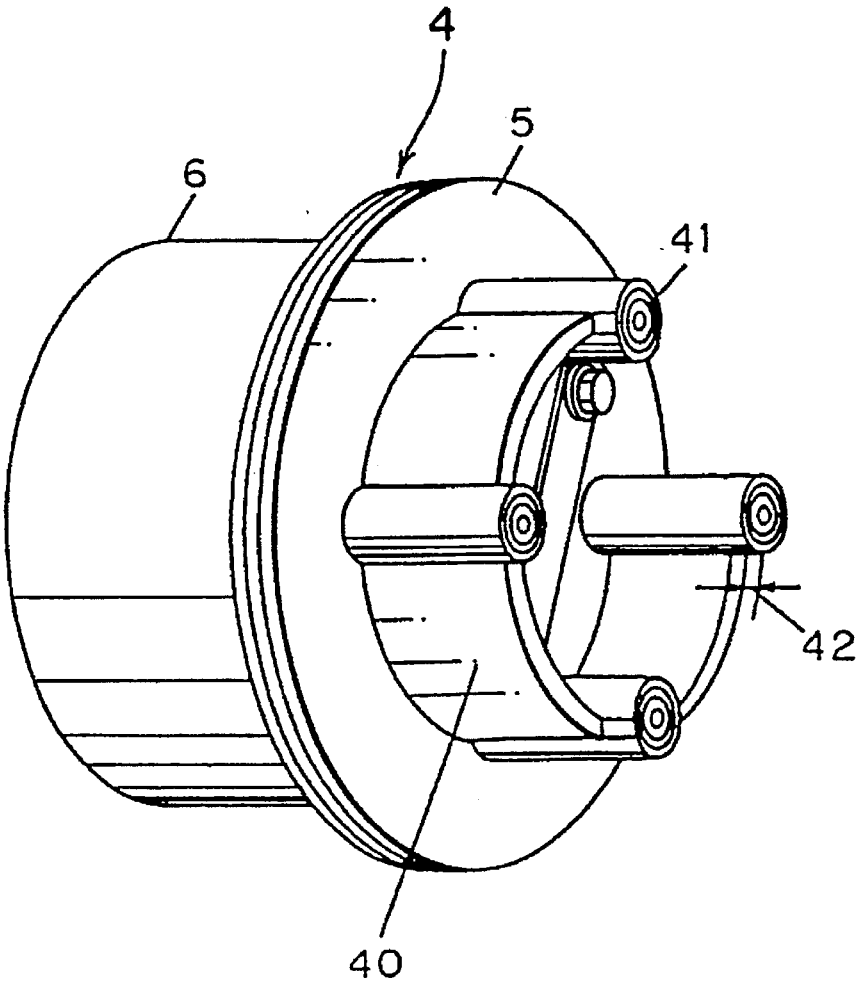
FIG. 4 is an enlarged perspective view of a stationary scroll member mounted in the scroll compressor of FIG. 3.
Figure 5:
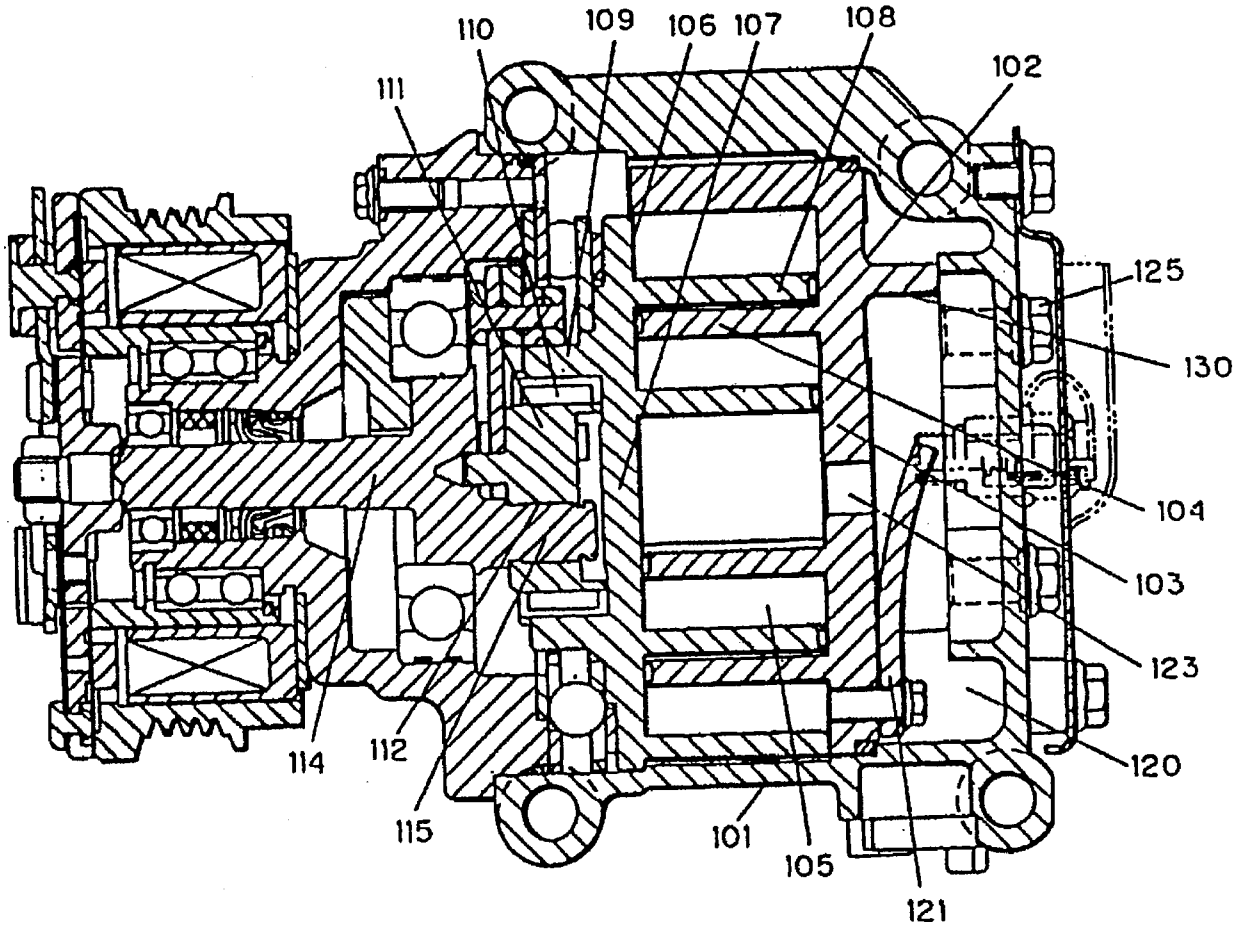
Fig 5 PRIOR ART
FIG. 5 is a longitudinal sectional view of a conventional scroll compressor.
Figure 6:
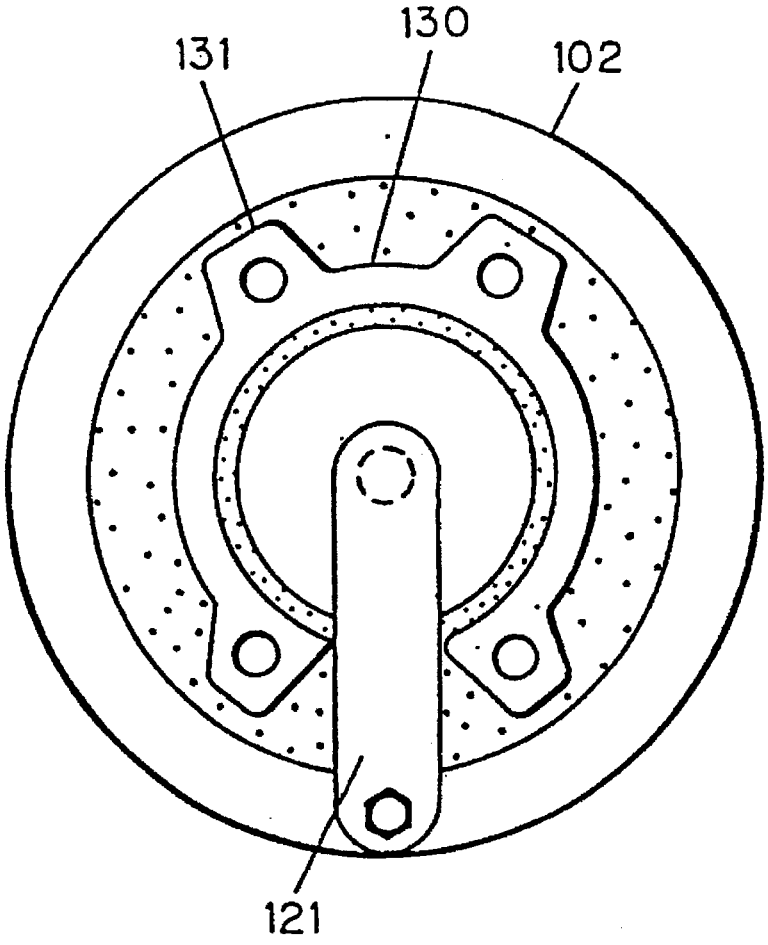
Fig. 6 PRIOR ART
FIG. 6 is an enlarged rear end view of a stationary scroll member mounted in the conventional scroll compressor of FIG. 5.

FIG. 3 depicts a scroll compressor according to a second embodiment of the present invention which includes a stationary scroll member 4 shown in FIG. 4. The stationary scroll member 4 is comprised of a stationary end plate 5, a stationary scroll wrap 6 protruding axially from one end surface of the stationary end plate 5, a generally horseshoe-shaped partition wall 40 protruding axially from the other end surface of the stationary end plate 5, and a plurality of spaced mounting legs 41 protruding axially from the other end surface of the stationary end plate 5 and continuous with the partition wall 40 so that the partition wall 40 extends between the plurality of spaced mounting legs 41. Each of the mounting legs 41 has a thickness greater than that of the partition wall 40 and also has a height slightly greater than that of the partition wall 40.

When the stationary scroll member 4 is secured to the rear casing 3 using fastening members 43 such as, for example, bolts, the partition wall 40 is spaced from the rear casing 3 so as to define gaps 42 therebetween and between the mounting legs 41. These gaps 42 act to absorb strains resulting from tightening of the fastening members 43 and prevent deformation of the stationary end plate 5, thus avoiding a reduction in performance of the compressor which has been hitherto caused by leakage of the refrigerant between the scroll wraps 6 and 7.

It is to be noted here that the stationary scroll member 4 shown in FIGS. 2A and 2B may be formed with the partition wall 40 and the mounting legs 41 both shown in FIG. 4.

Although the present invention has been described in connection with the preferred embodiments thereof with reference to the accompanying drawings, it is to be noted that various changes and modifications will be apparent to those skilled in the art. By way of example, although the present invention has been fully described in connection with the open-type compressor for use in an automotive vehicle in which a low pressure evolves within the compressor housing, the present invention is not limited to such type and is equally applicable to a hermetically sealed scroll compressor having an electric motor built therein and a high-pressure type compressor, both of which includes the compressor housing in which a high pressure evolves.

Accordingly, such changes and modifications are to be understood as included within the scope of the present invention as defined by the appended claims, unless they depart therefrom.

What is claimed is:

1. A scroll compressor comprising:

a compressor housing;

a stationary scroll member accommodated in said compressor housing and having a stationary end plate, a stationary scroll wrap protruding axially from a first surface of said stationary end plate, a generally horseshoe-shaped partition wall protruding axially from a second surface of said stationary end plate opposite to the first surface, and a plurality of spaced mounting legs protruding axially from the second surface of said stationary end plate and secured to a generally flat inner surface of said compressor housing, each of said plurality of spaced mounting legs having a thickness greater than that of said partition wall and also having a height slightly greater than that of the entire partition wall so that, of said partition wall and said mounting legs, only end faces of said mounting legs are held in contact with said generally flat inner surface of said compressor housing;

an orbiting scroll member accommodated in said compressor housing and having an orbiting end plate and an orbiting scroll wrap protruding axially from said orbiting end plate, said orbiting scroll wrap being in engagement with said stationary scroll wrap to define a plurality of working pockets therebetween, said orbiting end plate being formed with a generally cylindrical boss extending in a direction away from said stationary scroll member;

an orbiting bearing received in said cylindrical boss;

an eccentric bush inserted rotatably into said orbiting bearing;

a main shaft rotatably supported within said compressor housing and having a longitudinal axis;

an eccentric shaft extending from one end surface of said main shaft and having a longitudinal axis parallel to, but offset laterally from the longitudinal axis of said main shaft, said eccentric shaft being engaged in said eccentric bush; and a constraint member for preventing rotation of said orbiting scroll member about its own axis but allowing said orbiting scroll member to undergo an orbiting motion relative to said stationary scroll member.

2. A scroll compressor comprising:

a compressor housing;

a stationary scroll member accommodated in said compressor housing and having a stationary end plate, a stationary scroll wrap protruding axially from a first surface of said stationary end plate, a generally horseshoe-shaped partition wall protruding axially from a second surface of said stationary end plate opposite to the first surface, and a plurality of spaced mounting legs protruding axially from the second surface of said stationary end plate and secured to an inner end surface of said compressor housing, each of said plurality of spaced mounting legs having a thickness greater than that of said partition wall and also having a height slightly greater than that of the entire partition wall so that an entirety of an axial end face of said partition wall is spaced apart from said inner end surface of said compressor housing;

an orbiting scroll member accommodated in said compressor housing and having an orbiting end plate and an orbiting scroll wrap protruding axially from said orbiting end plate, said orbiting scroll wrap being in engagement with said stationary scroll wrap to define a plurality of working pockets therebetween, said orbiting end plate being formed with a generally cylindrical boss extending in a direction away from said stationary scroll member;

an orbiting bearing received in said cylindrical boss;

an eccentric bush inserted rotatably into said orbiting bearing;

a main shaft rotatably supported within said compressor housing and having a longitudinal axis;

an eccentric shaft extending from one end surface of said main shaft and having a longitudinal axis parallel to, but offset laterally from the longitudinal axis of said main shaft, said eccentric shaft being engaged in said eccentric bush; and a constraint member for preventing rotation of said orbiting scroll member about its own axis but allowing said orbiting scroll member to undergo an orbiting motion relative to said stationary scroll member.

* * * * *